US005170979A

United States Patent [19]

Baber

[11] Patent Number: 5,170,979

[45] Date of Patent: Dec. 15, 1992

[54] UNIVERSAL PACKAGE HOLDER

[75] Inventor: Roy R. Baber, Spartanburg, S.C.

[73] Assignee: Milliken Research Corporation, Spartanburg, S.C.

[21] Appl. No.: 843,149

[22] Filed: Feb. 28, 1992

[51] Int. Cl.[5] ..... A47F 5/00

[52] U.S. Cl. ..... 248/309.2; 242/130.1; 242/131

[58] Field of Search ..... 248/309.2, 316.2, 231.2; 242/131, 130, 130.1, 134, 141

[56] References Cited

U.S. PATENT DOCUMENTS

| | | | |
|---|---|---|---|
| D. 23,864 | 10/1913 | Bramston . | |
| 2,437,100 | 3/1948 | Lambach | 242/130.1 |
| 3,167,310 | 1/1965 | Rosekrans . | |
| 3,168,996 | 2/1965 | Vossen | 242/131 |
| 3,850,394 | 11/1974 | Raach et al. . | |
| 4,485,987 | 12/1984 | Simpson | 242/130.1 |
| 4,705,231 | 11/1987 | Green | 242/131 X |
| 4,765,562 | 8/1988 | Gabalda . | |
| 4,941,622 | 7/1990 | Alexander | 242/130.1 X |
| 4,995,569 | 2/1991 | Alexander . | |

FOREIGN PATENT DOCUMENTS

| | | |
|---|---|---|
| 946602 | 8/1956 | Fed. Rep. of Germany . |
| 3229036 | 5/1984 | Fed. Rep. of Germany . |
| 23864 | 10/1913 | United Kingdom . |

*Primary Examiner*—Alvin C. Chin-Shue
*Assistant Examiner*—Sarah Lechok
*Attorney, Agent, or Firm*—Earle R. Marden; H. William Petry

[57] ABSTRACT

A universal package support for packages of yarn having various inside diameters and lengths. The support has a movable disc slidably supported on a shaft which slides in and out to actuate a plurality of pivotally mounted levers to engage and disengage the interim surface of a yarn tube placed thereon.

5 Claims, 3 Drawing Sheets

UNIVERSAL PACKAGE HOLDER

This invention relates generally to package holders for bobbins, tubes, pirns, etc. for yarn wound thereon and more specifically to a universal holder which can be employed to readily support a number of different size bobbins, tubes or pirns.

In many textile operations such as knitting, weaving, warping, scrim manufacturing, etc. it is necessary to support a plurality of packages of yarn on a creel adjacent to the particular machine consuming the yarn. Depending on the particular textile manufacturing operation and the yarn supplied, the yarn may be supplied on a bobbin, tube, pirn, etc., the sizes of which vary widely. By size is meant the inside diameter and/or the length of the yarn supporting structure and various size yarn tubes must be used on the same creel supplying a textile machine. This presents problems in changing from one size yarn supporter to another because it is time consuming and physically can be very difficult to accomplish.

Therefore, it is an object of the invention to provide a universal package holder which will readily accommodate a variety of sizes of yarn packages with a minimum of difficulty and consumption of time.

Other objects and advantages of the invention will become readily apparent as the specification proceeds to describe the invention with reference to the accompanying drawings, in which.

Figure 1:
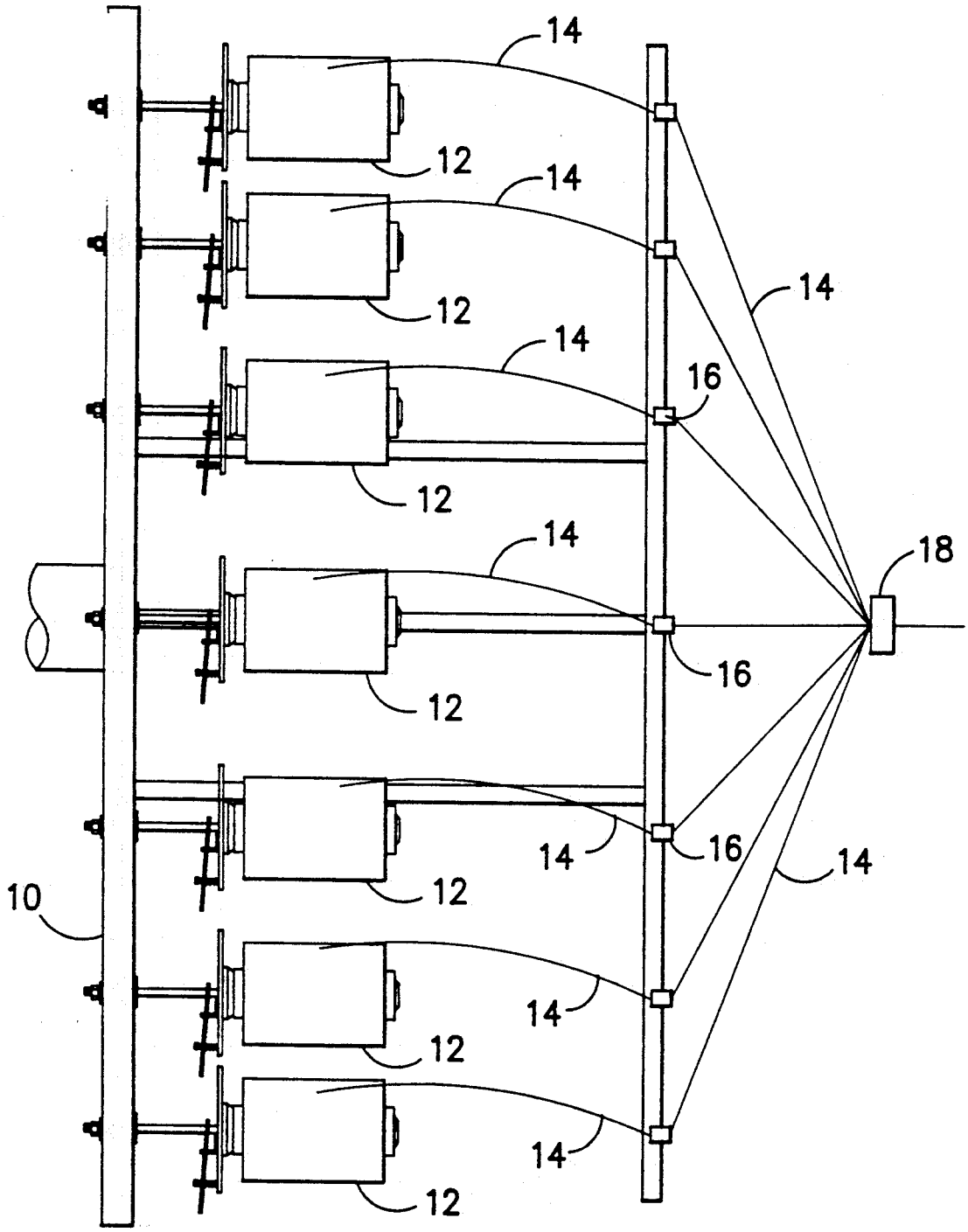
FIG. 1 is a typical creel arrangement for supplying a multiplicity of yarn ends to a textile machine.

Looking now to FIG. 1 a typical creel arrangement is shown wherein a plurality of yarn packages 12 are supplying yarn 14 to a textile machine (not shown). The particular machine is not part of the invention but the arrangement shown in FIG. 1 involves a rotating creel 10 from which the yarn 12 is delivered to yarn guides 16 and then supplied through a yarn supply mechanism 18 to a textile machine (not shown) producing scrim fabric for industrial use. This use is merely exemplary since yarn package 12 can be employed to supply yarn to other machines for other uses.

Figure 2:
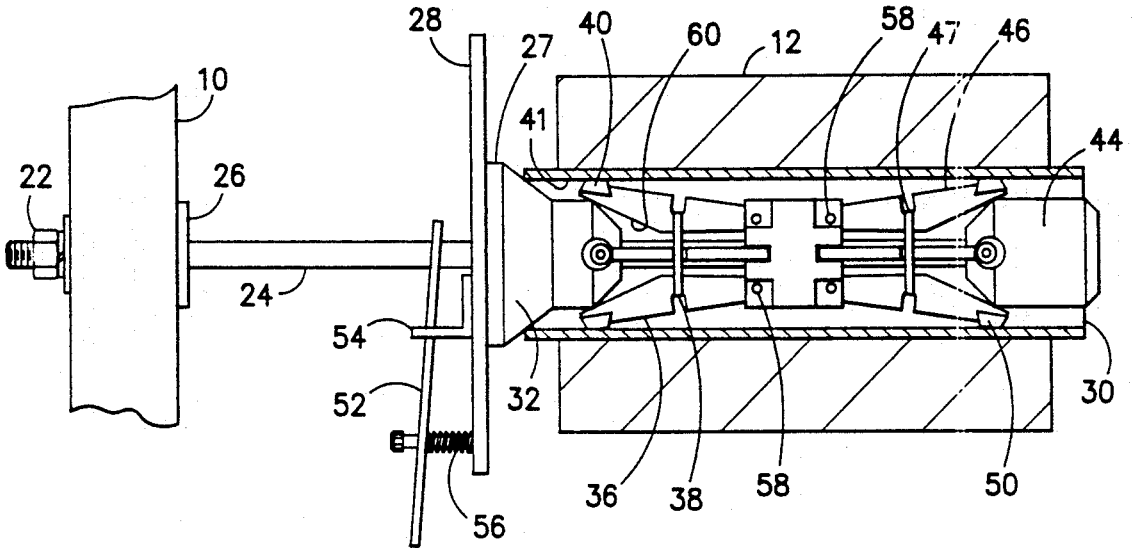
FIG. 2 is a partial section view of the new and improved package holder inserted in a yarn package.

FIG. 2 is a blown-up partial section view of one of the universal yarn package holders, generally designated 20, supporting a yarn package 12. The package holder 20 is supported in the creel 10 by the nut 22 screwed onto the center shaft 24 pulling the support plate 26 up against the creel 10. The truncated rear package support member 27, of nylon or other suitable material, mounted on the circular support plate 28, has been slid on the center shaft 24 into the package tube 30 until the beveled surface 32 has engaged the inside of the tube 30. The beveled front portion 34 of the package support member 27 is holding the pivoted lever arms 36 outwardly against the bias of elastic band 38 so that gripping cleats 40 engage the inside surface 41 of the tube 30. The sliding pivot block 42 has been slid towards the nose 44, of nylon or other suitable material, to cause the lever arms 46 to be pivoted outwardly against the bias of elastic band 47 by the beveled surface 48 to force the cleats 50 into engagement with the inner surface 41 of the tube 30 to firmly hold the package 12 in the desired position. The support plate 28 and consequently the rear support member 27 are locked into position by the release bracket 52 supported in the angle iron member 54 and braced against the center shaft 24 by the spring member 56.

Figure 3:
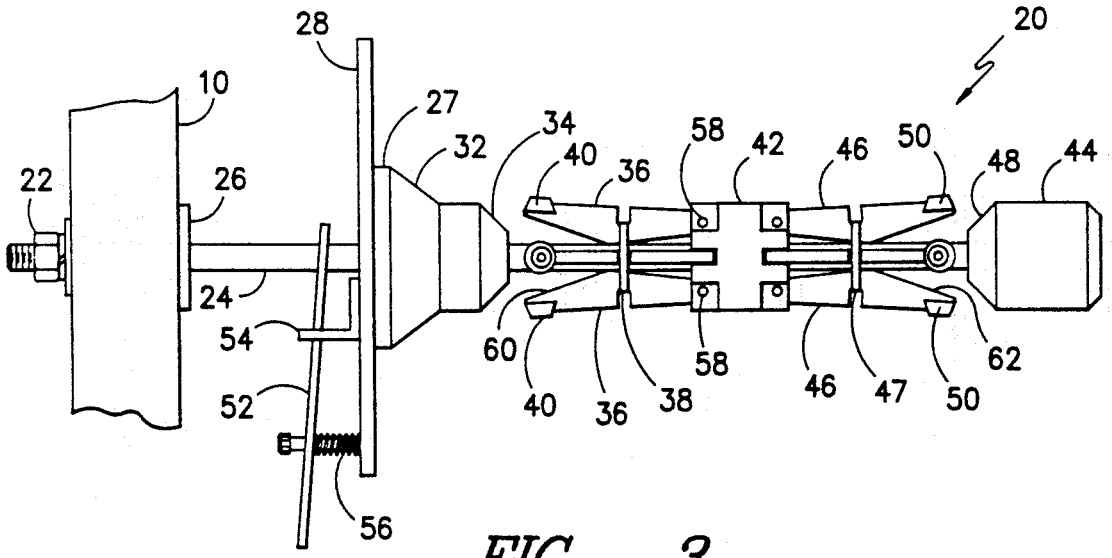
FIG. 3 is the yarn holder of FIG. 1 without a yarn package thereon.
Figure 4:
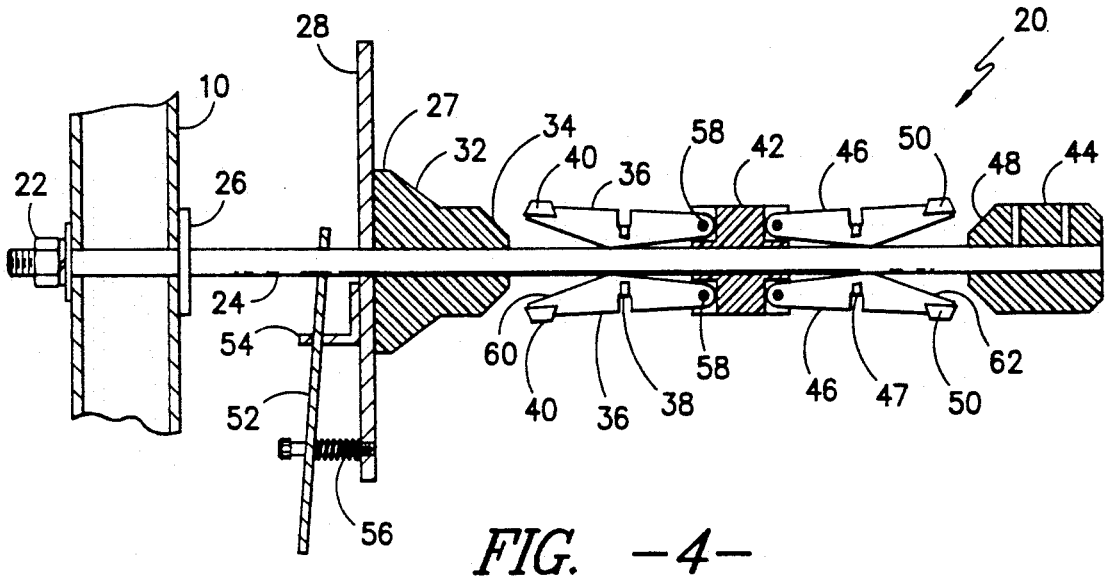
FIG. 4 is a partial section view of the yarn holder of FIG. 3 showing details thereof.

Looking now to FIGS. 3 and 4 the sliding pivot block 42 with pivot arms 36 and 47 pivotally connected thereto is shown in more detail. In the preferred form of the invention the block 42 is cylindrical and made of nylon and has four lever arms 36 and four lever arms 46 pivotally connected thereto by suitable pins 58. The arms 36 and 46 are each spaced around the periphery of the block 42 approxmately 90° from the next adjacent lever arms.

OPERATION

Figure 5:
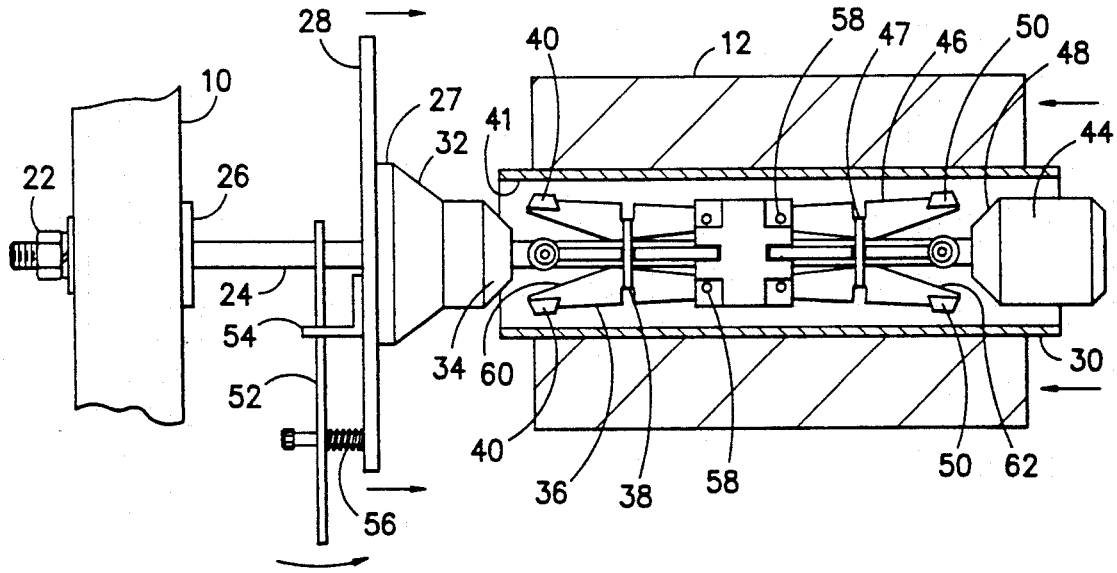
FIG. 5 illustrates the mounting and dismounting of a yarn package on the universal package holder.

As discussed previously the universal package holder 20 is mounted on the creel 10 and the release bracket 52 has been depressed to slide the circular plate 28 towards the creel 10 and to allow the sliding pivot block 42 and connected lever arms 36 and 46 to return to the position shown in FIGS. 3–5. The package 12 to be mounted on the creel 10 is placed on the holder with the tube 30 telescoping the sliding block 42 and is slid towards the circular plate 28. Then the circular plate is slid towards the outer open end of the tube 30. The brake lever 52 moves freely on the shaft 24 towards the nose 44. As the circular plate 28 is slid towards the nose end, the beveled surface contacts the truncated surface 60 of the lever arms 36 to cause them to pivot outwardly against the bias of rubber band 38 towards the inner surface 41 of the tube 41. At the same time the sliding block 42 is being slid towards the outer open end of the tube until the angled surface 62 of the lever arms 46 contacts the beveled surface 48 of the nose member 44 fixed on the outer end of shaft 24 and are pivoted against the bias of elastic band 47. The circular plate 28 continues to be slid towards the outer end of the tube 30 until the cleats 40 and 50 firmly grip the inner surface of the tube 30 and the package 12 is firmly seated. The brake lever 52 holds the mechanism and yarn package in position by not allowing movement towards the creel 10.

To remove the tube 30 after it has been depleted or partially depleted the release bracket 52 is again depressed and the circular plate 28 is slid on the shaft 24 towards the creel 10 to allow the rubber bands 38 and 47 to pivot the lever arms 36 and 46 towards the shaft 24 to release the grip on the inner surface of the tube 30 so that the tube 30 can be easily slid off the free end of the package holder 20.

It can be seen that a universal yarn package holder has been described that is self-centering and can support a number of different packages having varying tube diameters and/or lengths with removal or changing of the holder in the creel. It can be seen that the package holder can be readily accessed from the front of the creel and that no excessive adjustment is needed to the nose of the mechanism. This allows pirns with a closed end to be used. Another important feature of the invention for textile manufacturing is that the same centerline will be maintained for the packages mounted thereon regardless of the diameter of the package tube or the length of the package tube support. Furthermore, the novel package holder can be easily operated by a single operation in minimum time without excessive movement of the packages to properly align them to supply yarn to the desired machine. Also yarn packages are firmly supported since no springs are used in the support mechanism. This allows use or application in a moving or rotating creel where rigid support is essential.

The herein-described universal yarn package holder is the preferred embodiment of the invention and it is contemplated that changes may be made within the scope of the invention and it is therefore requested that the invention be restricted only by the scope of the claims.

I claim:

1. A universal yarn package holder comprising: a shaft adopted to be rigidly mounted to a creel, a plate member telescoping said shaft and slidable thereon, a nose member on the end of said shaft, a block member slidably mounted on said shaft between said plate member and said nose member, a plurality of levers pivotally mounted on both sides on said block member, bias means connected to said levers biasing said levers toward said shaft and means on said plate member to cause said levers to pivot outwardly from said shaft against bias of said bias means when said plate member is slid towards said nose member when a yarn tube is placed over said yarn package holder, said means on said plate member being a truncated member with a beveled end which engages said levers.

2. The package of claim 1 wherein the bottom of each of said levers is cut on an angle.

3. The package support of claim 2 wherein the portion of said nose member facing towards said collar member is beveled.

4. The package support of claim 3 wherein the side of said collar member away from said nose member has a locking means mounted thereon to lock said collar member into a selected position on said shaft.

5. The package support of claim 4 wherein said locking means is spring loaded towards the locking position.

* * * * *